US008985900B2

(12) United States Patent
Freitag et al.

(10) Patent No.: US 8,985,900 B2
(45) Date of Patent: Mar. 24, 2015

(54) CONTINUOUS FLUID TIGHTNESS FOR A CIVIL ENGINEERING WORK

(75) Inventors: Nicolas Freitag, Orsay (FR); Jean-Claude Morizot, Paris (FR)

(73) Assignee: Terre Armee Internationale, Velizy Villacoublay (FR)

( * ) Notice: Subject to any disclaimer, the term of this patent is extended or adjusted under 35 U.S.C. 154(b) by 0 days.

(21) Appl. No.: 13/639,375

(22) PCT Filed: Apr. 4, 2011

(86) PCT No.: PCT/EP2011/055204

§ 371 (c)(1),
(2), (4) Date: Oct. 4, 2012

(87) PCT Pub. No.: WO2011/138105

PCT Pub. Date: Nov. 10, 2011

(65) Prior Publication Data

US 2013/0022403 A1 Jan. 24, 2013

(30) Foreign Application Priority Data

May 7, 2010 (FR) ..... 10 53588

(51) Int. Cl.
*E02B 3/10* (2006.01)
*E02D 17/18* (2006.01)
*E02D 29/02* (2006.01)

(52) U.S. Cl.
CPC ..... *E02D 29/0241* (2013.01); *E02D 29/0225* (2013.01)
USPC ..... 405/107; 405/114; 405/150.1; 405/151; 405/284; 405/286; 52/432; 52/565; 52/699

(58) Field of Classification Search
CPC ..... E02D 29/0241; E02D 29/0225; E02D 29/0266; E02D 5/74
USPC ..... 405/107, 109, 114, 116, 117, 150.1, 405/151, 152, 262, 270, 272, 286; 52/432, 52/565, 699–701
See application file for complete search history.

(56) References Cited

U.S. PATENT DOCUMENTS 4,659,252 A * 4/1987 Sexton et al. ..... 405/109
4,952,097 A 8/1990 Kulchin
5,800,097 A * 9/1998 Martin ..... 405/284

(Continued)

FOREIGN PATENT DOCUMENTS

JP 2003 293376 A 10/2003
WO 03 004781 A1 1/2003

(Continued)

*Primary Examiner* — John Kreck
*Assistant Examiner* — Carib Oquendo
(74) *Attorney, Agent, or Firm* — McKenna Long & Aldridge LLP

(57) ABSTRACT

A civil engineering work (1) comprising a front face (9), a facing (3) having a back surface (32) and a front surface (31) that is substantially the same as said front face (9) of the work, a fluid-tight covering (4) on the back surface, a fill (2) arranged behind said fluid-tight covering (4), and an anchoring device (6) ensuring a mechanical linkage between the facing (3) and the fill (2), with said facing (3) comprising a cavity (5) inside of which a portion of the fluid-tight covering (4) is arranged to form a recessed space into which is inserted an anchoring element (16) that is a part of said anchoring device (6), and a method for implementing such a work.

14 Claims, 5 Drawing Sheets

(56) References Cited

U.S. PATENT DOCUMENTS

Figure 1:
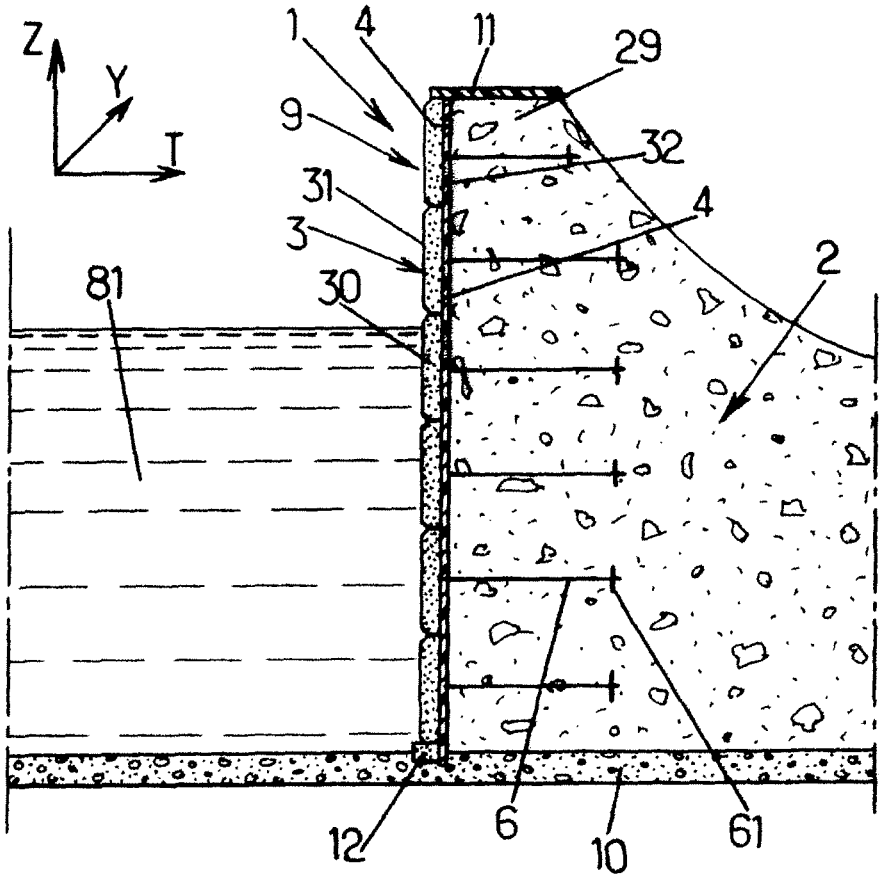

| | | | | |
|---|---|---|---|---|
| 5,839,855 | A * | 11/1998 | Anderson et al. | 405/262 |
| 6,053,662 | A * | 4/2000 | Scuero | 405/107 |
| 6,468,004 | B1 * | 10/2002 | Price | 405/262 |
| 6,719,487 | B2 * | 4/2004 | Yukimoto et al. | 405/16 |
| 7,029,204 | B1 * | 4/2006 | Webber et al. | 405/129.8 |
| 7,491,018 | B2 * | 2/2009 | Freitag et al. | 405/262 |

FOREIGN PATENT DOCUMENTS

| | | | | |
|---|---|---|---|---|
| WO | WO 03/004781 | * | 1/2003 | E02D 29/02 |
| WO | 2007 012864 A1 | | 2/2007 | |

* cited by examiner

CONTINUOUS FLUID TIGHTNESS FOR A CIVIL ENGINEERING WORK

This application is a 35 U.S.C. National Stage Entry of International Application No. PCT/ EP2011/055204, filed Apr. 4,2011 and claims the benefit of French Application No. 1053588, filed May. 7,2010,all of which are incorporated by reference in their entirety herein.

This invention relates to civil engineering works and their fluid tightness.

In particular, it concerns a civil engineering work comprising:

a front face, a facing rising from a substructure, said facing having a back surface and a front surface that is substantially the same as said front face of the work, a fluid-tight covering on the back surface, a fill arranged behind said fluid-tight covering, and at least one anchoring device ensuring a mechanical linkage between the facing and the fill, Such civil engineering works are known in the prior art, for example in document U.S. Pat. No. 60,536,62. In the solution described in that document, the anchoring device passes through the fluid-tight covering, and costly and complex supplemental means for achieving fluid-tightness must be installed at the places where the anchoring device passes through the fluid-tight covering.

The aim of this invention is to improve civil engineering works of this type.

In the invention, said facing comprises at least one cavity inside of which a portion of the fluid-tight covering is arranged to form a recessed space into which is inserted an anchoring element that is a part of said anchoring device, and the cavity and the recessed space are configured to allow mechanically anchoring the anchoring device in the facing.

The installation of costly and complex additional devices for achieving fluid-tightness can thus be avoided, as well as the possibility of weaknesses in the general fluid-tightness of the work.

In various embodiments of the invention, one and/or another of the following arrangements may also be used:

the fluid-tight covering comprises a substantially flat sealing plate adjacent to the back surface of the facing, and said portion of the fluid-tight covering forming a recessed space is a sealing member substantially following the inner shape of said cavity, said sealing plate and said sealing member being connected by a fluid-tight preferably liquid-tight seal, the seal is achieved by heat welding or adhesive, the facing comprises a plurality of assembled precast slabs comprising at least one cavity for housing a portion of the fluid-tight covering, the fill is realized of reinforced earth and/or roller-compacted concrete and/or poured concrete and/or stone aggregate, the fluid-tight covering is of plastic material, for example high density polyethylene (HDPE), the anchoring device comprises a reinforcing strip, the sealing plate comprises a through-hole next to the cavity and the seal is realized along the perimeter of said through-hole, the facing is of concrete, the work is chosen from among a list of works consisting of a dam, an embankment, a canal levee, a fluid retaining structure, and a containment structure for materials that produce leachate.

In one embodiment of the invention:

the cavity consists of a recessed portion forming a passage comprising at least one open loop, inside the facing, and with at least one opening into the back surface of said facing; in this embodiment, the passage may comprise two openings into the back surface of said facing, two rectilinear portions which are respectively adjacent to said openings and parallel to a direction of pull that is substantially perpendicular to the back surface of the facing, two curved portions that extend the two rectilinear portions and are sloped relative to the direction of pull, and at least one bend connecting the two curved portions.

In another embodiment, the bend of the passage may wrap around a reinforcement structure inserted in the facing.

In another embodiment, the anchoring element may comprise a projection which extends transversely to a direction of pull substantially perpendicular to the back surface of the facing, and said cavity comprises a supporting section against which said projection from said anchoring element presses.

In another embodiment, the anchoring element may be a key that can be inserted into the cavity and turned a quarter turn into an anchoring position.

In another embodiment, the anchoring element is a bolt overmolded with a layer of plastic material forming said sealing member substantially following the shape of the cavity.

The invention also relates to a facing slab that can be assembled and can constitute a facing of a civil engineering work as defined above. Said slab has a front surface and a back surface, and comprises at least one cavity opening only onto said back surface, with a fluid-tight covering, for example liquid-tight covering, arranged continuously on the back surface of the back side. The cavity is suitable for forming a recessed space which can receive an anchoring element, a portion of the fluid-tight covering being arranged inside said cavity.

The invention also relates to a method for realizing a civil engineering work as defined above. The method comprises the following steps:

a) erecting the facing on the substructure, with said facing comprising the fluid-tight covering, b) installing a plurality of anchoring devices, c) installing the fill.

In another embodiment, the anchoring devices are also reinforcements which stabilize the fill by interacting with it.

In various embodiments of the method of the invention, one and/or the other of the following steps may additionally be used:

the work is realized in successive layers and steps a) through c) are repeated as many times as is necessary to substantially reach the desired height for the work.

step b), in which a plurality of anchoring devices are installed, comprises an operation of inserting the reinforcing strip into the cavity, said method additionally comprising a next step of adhering or heat-welding the fluid-tight covering between different layers in order to establish a fluid-tight seal.

Figure 2:
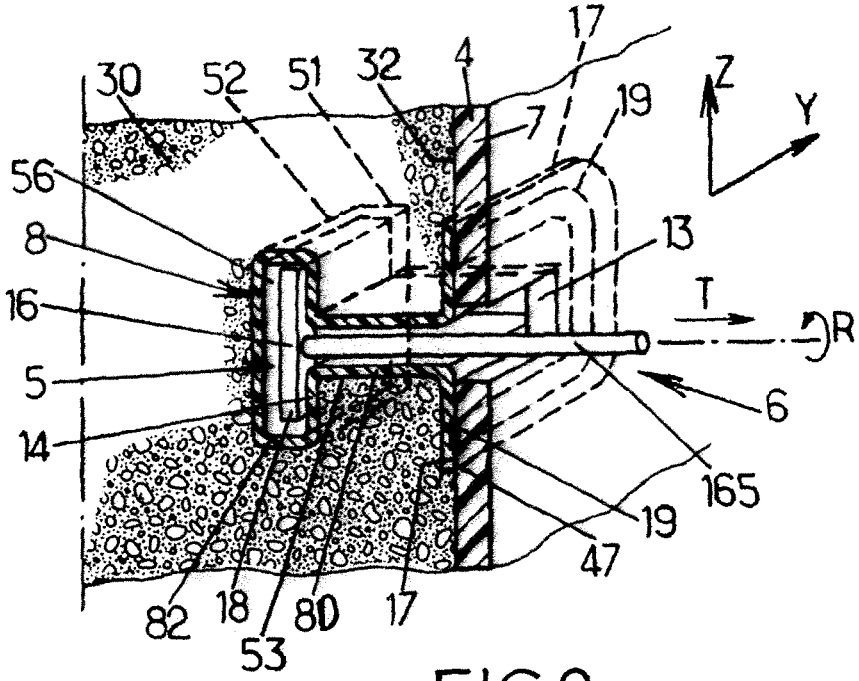
Figure 3:
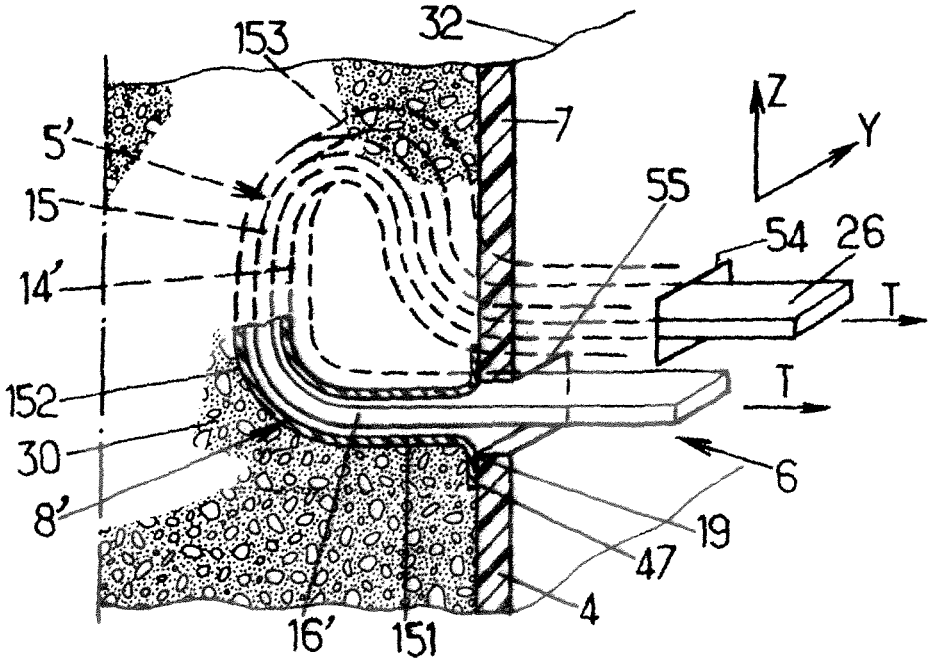
Figure 4:
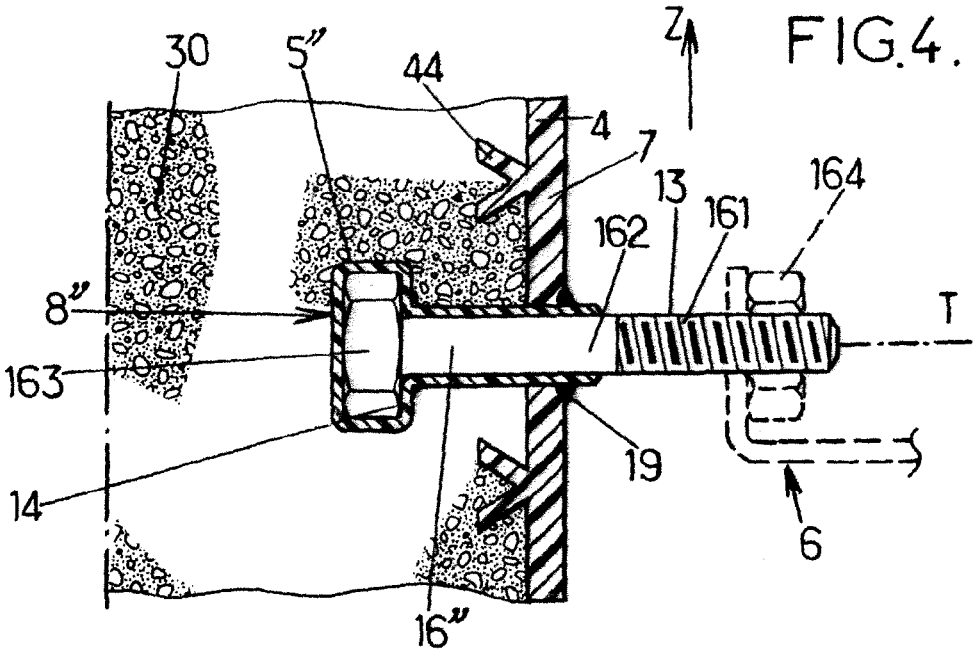
Figure 5:
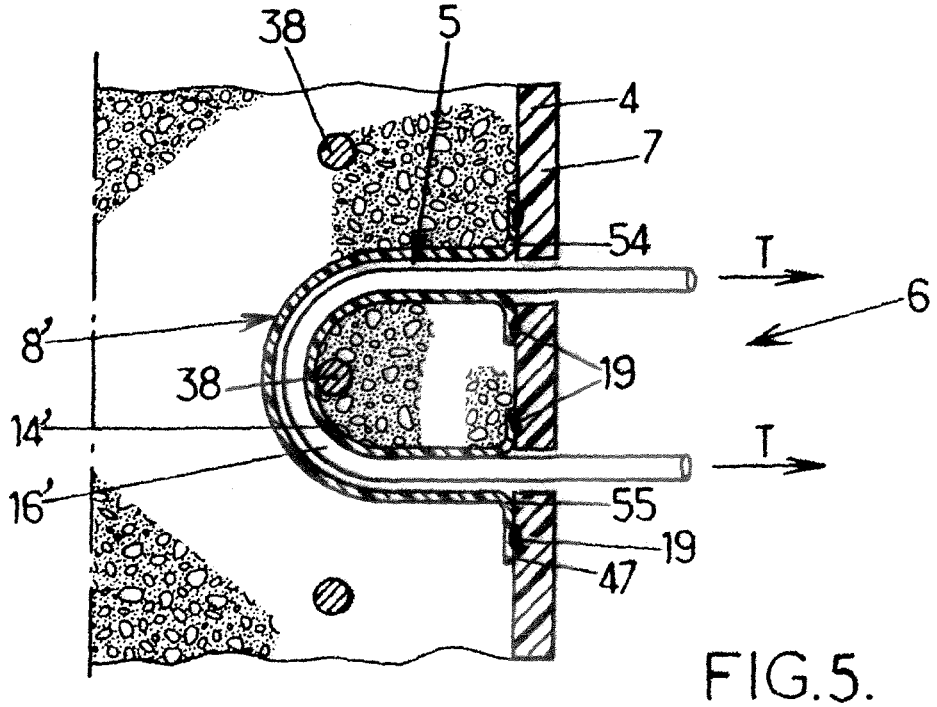
Figure 6:
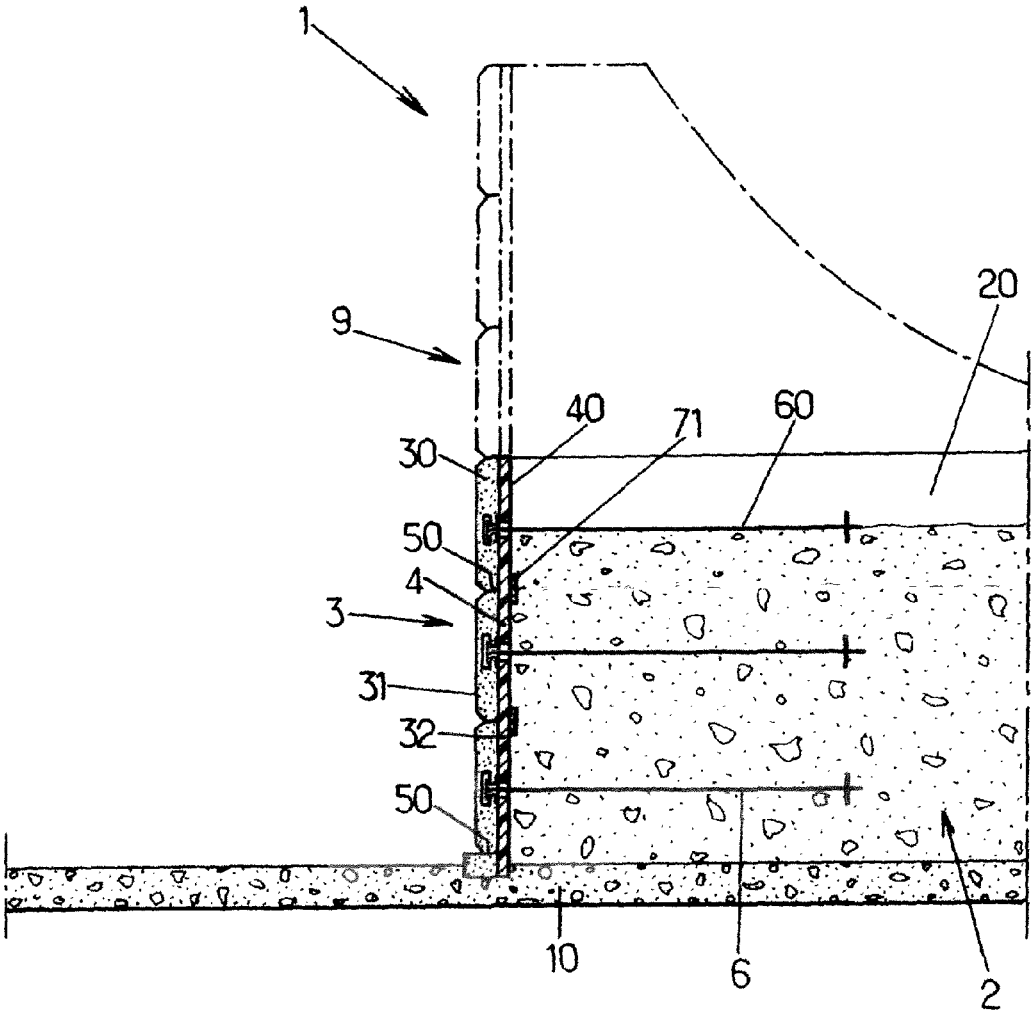
Figure 7B:
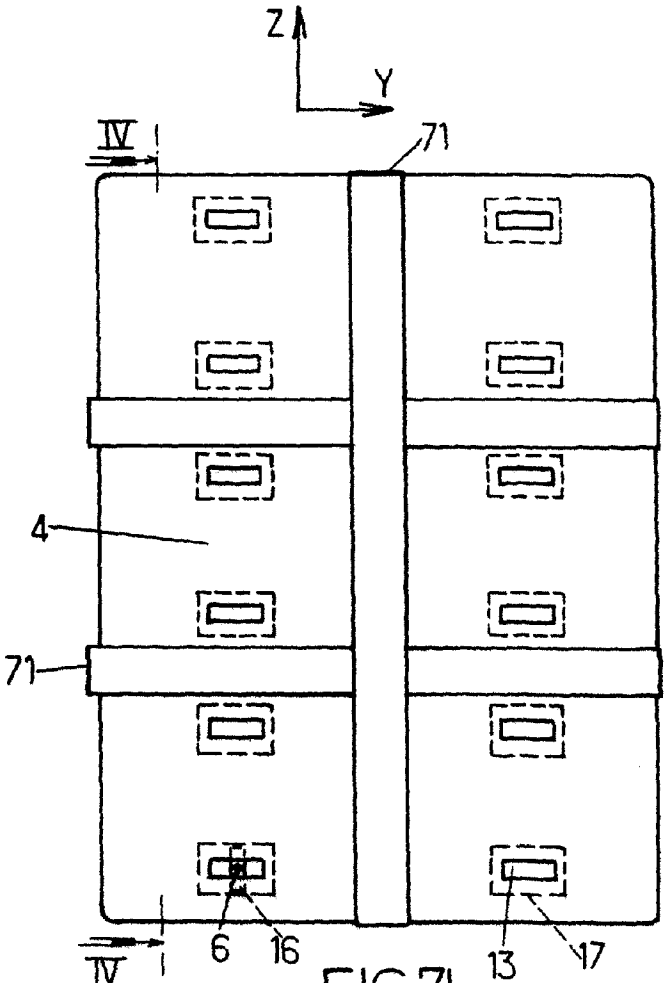
Figure 7A:
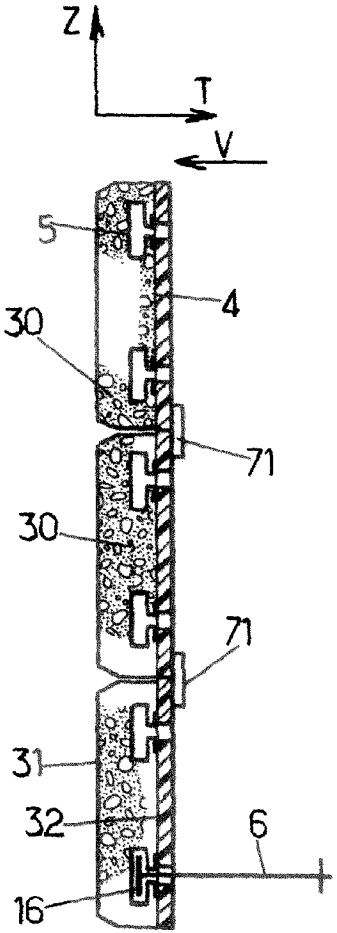

Other features, aspects, and advantages of the invention will be apparent from reading the following description of several of its embodiments provided as non-limiting examples. The invention will also be better understood by referring to the attached drawings, in which:

FIG. 1 is a schematic cross-sectional view of a civil engineering work of the invention, FIG. 2 is a detailed cross-sectional view of the fluid-tight covering, a cavity, and an element of the anchoring device according to a first embodiment of the invention, FIG. 3 is a view analogous to the one in FIG. 2 according to a second embodiment of the invention, FIG. 4 is a view analogous to the one in FIG. 2 according to a third embodiment of the invention;

FIG. 5 is a view analogous to the one in FIG. 2 but for a variant of the second embodiment of the invention, FIG. 6 is a schematic cross-sectional view of a civil engineering work illustrating a construction method according to the invention, FIGS. 7*a* and 7*b* show the assembly of multiple facing slabs and of the fluid-tight covering.

In the different figures, the same references denote similar or identical elements.

"Rear", "behind", or "back" in the sense of the invention refer to the position of an element relative to another element in the direction of the arrow T illustrated in the figures.

As an example, a civil engineering work of the invention may be a dam, a dyke, a fluid retention structure, a canal levee, a containment structure for materials that produce leachate, a construction intended to enlarge or raise an existing work, a slope delimited by a facing, or more generally any other civil engineering work.

FIG. 1 represents a civil engineering work 1 of the invention, comprising:

- a facing 3 extending from a substructure, which is the earth 10 in the example represented,
- a fill 2 for the work, situated behind the facing,
- and a fluid-tight covering 4 between said facing 3 and said fill 2, for which the function will be detailed in the rest of the description.

The facing 3 of the work 1 comprises a front face 9 against which rests an area 81 (also named upstream area 81) of material. Said material may be a liquid such as water or polluted effluent. In addition, said upstream area 81 of material may comprise waste from which toxic liquid materials may escape, or any other elements which are to be confined in front of the front face 9 of the work 1. Without departing from the present invention, said upstream area 81 may contain lights fluids like gazes.

The facing 3 is substantially vertical as illustrated in FIG. 1 (in the direction labeled "Z"), and comprises a front surface 31 substantially the same as the front face 9 of the work, and a back surface 32 situated on the opposite side from the front surface 31 and against which the fluid-tight covering 4 rests. In the example illustrated, the facing 3 is a concrete wall of any type of concrete known to the art. The wall may be constructed continuously or in a modular manner as illustrated in FIG. 1, where superimposed precast concrete slabs 30 are assembled at the work site during construction.

The fluid or liquid in the area 81 of material presses against the front surface 31 of the facing, but does not press against the fluid-tight covering 4 which is located on the back surface of the facing 3 and is therefore protected from the mechanical and other stresses which may result from the interaction of the materials contained in the upstream area 81 with the front face 9 of the work 1.

It should be noted that the facing 3 may be sloped and the non-submerged portion of the front face may be covered with vegetation in certain cases.

The facing 3 may rest on a specific foundation 12 arranged at the base of the work, also called a substructure, which ensures the fluid-tightness relative to the underlying soil.

In the particular case of an operation involving the raising of a civil engineering work, the facing 3 will not rest directly on the ground but on a substructure arranged on the existing surface of the work to be raised.

The fluid-tight covering 4 is intended to prevent the fluids or liquids 81 situated upstream from penetrating into the fill 2 or beyond, and it is therefore desirable that it provide a continuous fluid-tight seal from the substructure 10 up to the maximum height of the fluid.

In a similar manner, it is apparent that the fluid-tight covering 4 is adapted to prevent fluids or liquids situated in the fill 2 from penetrating into the upstream area 81.

The fluid-tight covering 4 is generally realized of plastic material and can have a thickness of between 0.5 mm and 25 mm. The thickness represented in the figures has been intentionally exaggerated for better comprehension. The fluid-tight covering 4 seals against fluids, in particular liquids but not exclusively, with a continuous seal as this will be detailed below.

The most extensive portion of said fluid-tight covering 4 is formed by a substantially flat sealing plate 7 which covers and substantially follows continuously the shape of the back surface 32 of the facing 3.

The material of the fluid-tight covering 4 may be selected from the family of thermoplastic polymer plastics such as polyolefins (PE and PP), polyamides (PA), or polyethylene terephthalates (PET). Preferably, high density polyethylene (HDPE) is selected.

The fill 2 of the work may be realized in various ways, particularly by using reinforced earth and/or roller compacted concrete and/or poured concrete and/or stone aggregate; most often it is realized by installing successive layers from the ground or substructure 10 up to the top of the work. The fill 2 contributes to the stability of the civil engineering work 1 in question by means of its weight.

In addition, anchoring devices 6 are provided to ensure that the facing 3 is mechanically anchored to said fill 2.

These anchoring devices 6 are in the form of metal reinforcements or reinforcing strips of synthetic cloth or plastic material, or by any other means known to the art. These anchoring devices can also play a role in the mechanical stabilization of the fill 2.

The interface between these anchoring devices 6 and the facing 3 is an important point of the invention and will be described in more detail below.

The interface between the anchoring devices 6 and the fill occurs via an anchoring means 61 which secures the anchoring device 6 to the fill in the direction T.

A covering element 11 can protect the upper portion of the work, particularly the upper portion 29 of the fill, from weather which could cause the condition of the work to deteriorate, particularly the portion of the fill 2 near the facing.

A detailed view of an anchoring element 16 that is part of the anchoring device 6 is represented in FIG. 2. The anchoring element 16 is lodged inside the facing 3 as detailed below.

The facing 3, which in this example is one of the slabs 30 of this facing, comprises a cavity 5 forming a space 52 inside said slab 30 that opens into the back surface 32 of the facing 3. Preferably, said cavity 5 opens only on the back surface.

A portion of the fluid-tight covering is arranged within this cavity 5, in the form of a sealing member 8 forming a recessed space which substantially follows the shape of said cavity 5. Said sealing member 8 has the property of being fluid-tight, especially liquid-tight.

In the example illustrated, the cavity 5 and the sealing member 8 both have a T-shaped cross-section, said T-shaped cross-section comprising:

- a central arm 53,80 substantially perpendicular to the back surface 32 of the facing and substantially parallel to the direction of pull T of the anchoring force between the fill 2 and the facing 3, and a transverse arm 56,82 substantially parallel to the back surface 32 of the facing 3.

The cavity 5 and the sealing member 8 of such a T-shaped cross section extend horizontally in a direction Y that is parallel to the back surface 32 of the facing, between a first end 51 and a second end (not represented in FIG. 2). The distance separating the two ends is greater than the length of the transverse arm 82 of the T-shaped cross-section described above.

The sealing member 8 thus comprises a transverse pocket and a neck 80 forming the central arm of the T, and additionally comprises a connecting surface 17 that is substantially flat and substantially merged with the back surface 32 of the facing. This connecting surface 17 is adapted to fit tightly against the sealing plate 7 already mentioned, and the sealing plate 7 comprises an opening 13 to allow the passage of a portion of the anchoring device 6, for example the anchoring element 16. The sealing member 8 may or may not be of constant thickness, its thickness being for example between 0.5 mm and 25 mm.

Said sealing member 8 may be realized of plastic material, for example high density polyethylene (HDPE) or another thermoplastic polymer. Said sealing member 8 is assembled with said sealing plate 7 by means of the connecting surface 17 of the sealing member 8, which fits tightly against a portion 47 of the front face of said sealing plate 7 adjacent to the back surface 32 of the facing.

A fluid-tight seal 19 is established at the interface between the connecting surface 17 of the sealing member 8 and the portion 47 of the front face of said sealing plate 7. Said seal 19 forms a loop that encircles the opening 13 and follows the perimeter. This establishes a continuous seal connection between said sealing plate 7 and the sealing member 8.

It should be noted that the seal 19 may be realized by the use of heat welding or adhesive or any other means known to the art.

Similarly, it should be noted that the material of the sealing member 8 may be the same as or different than the material of the sealing plate 7, it being understood that if the seal 19 is heat welded, the chosen materials must be compatible for such heat welding.

In an unrepresented variant of the invention, the fluid-tight covering 4 can be obtained by a different method. In said variant, a specific sealing member 8 is not used, but the portion of fluid-tight covering 4 lodged in the cavity 5 is obtained by shaping the sealing plate 7. Instead of creating an opening 13 in said sealing plate 7, the plastic material is formed locally, for example by heat forming, so that it enters into the cavity 5 to form a pocket which acts as the portion of fluid-tight covering 4 that substantially follows the shape of the cavity 5. In this variant, there is no need to create said seal 19, although the following precautions must be taken:

- the thickness of the sealing plate 7 must be sufficient for the plastic forming to occur without tearing,
- channels for evacuating the air present in the cavity 5 must be provided inside the facing to allow the air to escape when the fluid-tight covering 4 forms a pocket that expands.

In another unrepresented variant of the invention, the fluid-tight covering 4 can be obtained by locally shaping the sealing plate 7 before the facing elements are molded. The sealing plate shaped in this manner is anchored in the molded material before it hardens or sets, so that there is no need for a seal 19 to achieve continuous fluid-tightness around the cavity 5.

The anchoring element 16 mentioned above, which is also in the shape of a T but with slightly smaller dimensions than those of the T formed by the interior of the sealing member 8, is inserted into the recessed space formed by the cavity 5 lined with its sealing member 8.

This anchoring element 16 comprises a primary shaft 165 parallel to the direction of pull T (having a round cross-section in the illustrated example), and at least one transverse projection 18 which extends transversely to the direction of pull T (in the illustrated example, two aligned projections form the transverse bar of the T). This projection 18 presses against a supporting portion 14 arranged in the cavity forming the recessed pocket of the sealing member 8.

The opening 13 arranged in the sealing plate 7 is a rectangle of which the long side is parallel to the horizontal direction Y contained within the plane of the back surface of the facing 3, its length being substantially equivalent to the distance separating the previously mentioned two ends 51 of the cavity 5.

The anchoring element 16 is inserted into the cavity 5 while the transverse arm 18 is parallel to the horizontal (in the Y direction), then when the arm is substantially pressing against the bottom of the cavity 5 said anchoring element 16 is pivoted a quarter turn around the direction of pull T (the arrow R in FIG. 2), so that this anchoring element 16 is moved in the position represented in FIG. 2 and thus mechanically anchors the anchoring device 6 to the facing 3. In this manner, the anchoring element 16 is similar to a key that is inserted and turned a quarter turn, for example, into a position where it is locked in place in its housing.

The fluid-tight covering 4, realized by the joining of the sealing plate 7 which closely follows the form of the back surface 32 of the facing, and of the sealing member 8 which closely follows the form of the cavity 5, establishes a fluid-tight, particularly liquid-tight seal that is completely continuous along the back surface 32 of the facing, given that the anchoring device 6 does not pass through said fluid-tight covering 4, but simply presses against one of the shapes arranged inside the sealing member 8.

As a result, there is no need to make use of sealing devices such as a sealing gland around the anchoring device 6 in order to obtain an optimum continuous seal between the facing 3 and the fill 2.

A second embodiment is represented in FIG. 3. Only the elements which are substantially different from those already described for the first embodiment will be described. In this second embodiment, the cavity 5 is a passage arranged in the facing 3 and having a first opening 54 into the back surface 32 of the facing and a second opening 55 which also opens into the back surface 32 of the facing. These two openings 54,55 are rectangular in shape and are located side by side at the same height vertically in the direction Z.

The sealing member 8' in this second embodiment is a sheath of plastic material substantially following the shape of the cavity 5' which defines a path. In this second embodiment, the anchoring device 6 comprises a reinforcing strip 26 which is a synthetic reinforcement in the form of a flexible strip with a substantially constant cross-section, and which can be manufactured based on polyester fibers coated with polyethylene for example. Said reinforcing strip 26 comprises a portion 16', lodged in the cavity 5, which acts as an anchoring element.

The path 15 of the recessed space forming the cavity 5 comprises at least one open loop 15 inside the facing 3, with each of the ends of the loop forming the two openings 54, 55 already mentioned.

In addition, this path may comprise two rectilinear portions 151 respectively adjacent to said two openings 54, 55 and substantially parallel to the direction of pull T, two curved portions 152 respectively extending said two rectilinear portions 151 and sloped relative to the direction of pull T, and at least one bend 153 which connects said two curved portions 152.

When using reinforcing strips 26 in a manner known to the art for reinforcing soils, the path 15 is preferably three dimensional (3D) so that the tensile forces are properly distributed inside the material of the facing 3; in particular, the supporting sections 14' on which the tensile force will be exerted represent a larger area than the transverse cross-section of the reinforcing strip 26. The considerations concerning the materials of the fluid-tight covering 4 and the seal 19 are similar or identical in this second embodiment, and are not repeated (see first embodiment).

It is to be noted that, in this second embodiment of the invention, the openings 54, 55 can be brought closer together to the point where they are merged, and in this case the path entry and exit are the same opening.

FIG. 4 represents a third embodiment of the invention. Only the elements which are substantially different from those already described for the first embodiment will be detailed. In this embodiment, the anchoring element 16" is in the form of a standard bolt having a head 163 and a shaft 162 that is threaded 161. The head 163 of the bolt is inserted and lodged in a cavity 5" arranged in the facing 3. In this example, the sealing member 8" is in the form of overmolding around the bolt 16". The overmolding is realized prior to pouring the concrete of the facing around the bolt wrapped in its overmolding 8". One can see that the topology of this third embodiment is equivalent to that of the previous two embodiments although the anchoring element 16" is inseparable from the sealing member 8" after said overmolding.

The sealing member 8" is connected to the sealing plate 7 by means of a seal 19 established by adhesive or heat welding as described for the previous embodiments, said seal or weld 19 in this specific case being circular.

FIG. 4 also shows that the sealing plate 7 can be equipped with projections 44 extending slantwise from the surface of said sealing plate 7 so that the mechanical attachment of the sealing plate 7 to the facing 3 is extremely strong after the concrete of the facing 3 is poured.

Note that this type of sealing plate 7 can also be implemented in the other embodiments presented.

In the case of the third embodiment, the anchoring device 6 is supplemented by elements partially represented in the figure, attached to the bolt by means of a nut 164 which locks the additional elements in place relative to the anchoring element 16".

A variant of the second embodiment is represented in FIG. 5, in which a reinforcing strip can be used or any other flexible connecting element which can be inserted into a cavity in the form of a conduit. In this example the cavity represented is C-shaped. The anchoring device can make use of cords, metal cables, or any other flexible connecting elements that are tensile resistant. In the illustrated example, a wire with a round cross section is used.

In this variant of the second embodiment, the open loop formed by the conduit surrounds a reinforcing structure 38 which is inside the concrete of the facing 3 when poured, as is known to the art for concrete reinforced with wire mesh for example.

Thus the reinforcing structure 38 is in contact with the portion of the sealing member 8' which supports the tensile forces exerted on the supporting section 14' by the anchoring element 16' formed by the portion of the cable inserted into the cavity 5'. The position of the sealing member 8' supported by at least one reinforcing structure 38 renders the assembly particularly strong. The cable can be anchored inside the fill by any transverse device (not represented in FIG. 5) attached to said cable.

The implementation of the cavity 5 and the portion 8 of the fluid-tight covering 4 inside it will now be described in detail.

A first solution consists of arranging a recessed cavity in the concrete when it is poured, ensuring the cavity has the desired shape for receiving an anchoring element 16, then installing a substantially flat sealing plate 7 behind the facing 3, and then locally shaping the sealing plate 7 next to the cavities 5 in a manner that pushes the fluid-tight covering 4 inside the cavity 5, as has already been described for one variant.

A second solution, in particular for realizing the first and second embodiments as described above, consists of positioning the sealing member 8 in the formwork for the facing 3, preferably in the formwork for the precast slab 30, while ensuring that the opening or openings barely touch the outside surface 32 of the precast slab. The concrete is then poured to fill the entire space of the slab 30 except for the volume inside the sealing member 8 which thus creates the cavity 5 mentioned above.

The rear sealing plate 7 can be installed prior to pouring the concrete so that it is a part of the precast concrete slab when it is made; the rear sealing plate 7 can also be installed later during the facing assembly process. It is preferred, however, to prepare the sealing member 8 and rear sealing plate 7 as well as the seal 19 which joins them, prior to pouring the concrete if this is compatible with the concrete shrinkage.

Of course, if using projections 44 extending into the facing from the sealing plate 7, as illustrated in FIG. 4, it is important to place the sealing plate 7 prior to pouring the concrete.

The process for assembling the civil engineering work 1 of the invention will now be described in detail.

In a first solution, the facing 3 is erected from the substructure 10 to its top, whether by continuous pouring or by successively assembling slabs of precast facing 30, the fluid-tight covering 4 being installed at the same time as the facing 3 according to the information described above; next a plurality of anchoring devices 6 is installed inside the cavities 5 in order to anchor the anchoring device 6 in the facing 3; and lastly the fill 2 is installed to insure the mechanical linkage between the anchoring device 6 and the fill 2.

In a preferred solution of the invention which refers to FIG. 6, the civil engineering work is realized in different layers: a portion of the facing 3 is erected on top of the substructure or the previously installed portion 50, for example a portion corresponding to the height of a precast slab 30 of the facing 3, with the fluid-tight covering 4,40 being installed with said facing 3; secondly the fill is installed up to the height where the anchoring devices 6 are to be installed; thirdly the anchoring devices 6,60 are installed in the cavities 5; and fourthly the fill 2,20 can be installed if necessary to immobilize the anchoring devices in position.

In addition, when proceeding by different layers, particularly when using precast slabs 30 in which the sealing plate 7 connected to the sealing member 8 are integrated during the prefabrication, it may be desirable to install an auxiliary seal to unite the fluid-tight preferably liquid-tight covering 4 of the freshly installed layer with the previous layer. To do so, a solution can be used for example involving an auxiliary sealing strip 71 as represented in FIGS. 7*a* and 7*b*, which forms a seal against liquid fluids, between the sealing plates 7 of one layer and the sealing plates 7 of another layer. These auxiliary sealing strips 71 may also be used to form a fluid-tight vertical seal, particularly liquid-tight seal between different slabs 30 situated next to each other in the same horizontal layer.

The invention claimed is:

1. A civil engineering work comprising:

a front face, separating an upstream area from a facing, the facing rising from a substructure, said facing having a back surface and a front surface that is the same as said front face of the work, a fluid-tight covering arranged continuously on the whole back surface, a fill arranged behind said back surface and said fluid-tight covering, said fluid-tight covering being adapted to prevent fluids situated in the upstream area from penetrating into the fill, and said fluid-tight covering being protected from material adjacent to the front face, and at least one anchoring device ensuring a mechanical linkage between the facing and the fill, wherein said facing comprises at least one cavity inside of which a first portion of the fluid-tight covering is arranged to form a fluid-tight recessed space into which is inserted an anchoring element that is a part of said anchoring device, and the cavity and the recessed space are configured to allow mechanically anchoring the anchoring device in the facing, the cavity having at least one mouth, wherein said fluid-tight covering comprises a second portion formed as a flat sealing plate adjacent to the back surface of the facing, and said first portion of the fluid-tight covering forming the recessed space is a sealing member following an inner shape of said cavity, the sealing member having a flat connecting surface encircling the cavity mouth, said flat sealing plate and said connecting surface of the sealing member being connected in a fluid-tight manner by a seal.

2. The civil engineering work according to claim 1, wherein said seal is achieved by heat welding or by adhesive.

3. The civil engineering work according to claim 1, wherein the facing comprises a plurality of assembled precast slabs comprising at least one cavity for housing a portion of the fluid-tight covering.

4. The civil engineering work according to claim 1, wherein the fill is realized of reinforced earth and/or roller-compacted concrete and/or poured concrete and/or stone aggregate.

5. The civil engineering work according to claim 1, wherein the fluid-tight covering is of plastic material.

6. The civil engineering work according to claim 1, wherein said anchoring device comprises a reinforcing strip.

7. The civil engineering work according to claim 1, wherein the cavity consists of a recessed portion forming a passage comprising at least one open loop, inside the facing, and with at least one opening into the back surface of said facing.

8. The civil engineering work according to claim 7, wherein the passage comprises two openings into the back surface of said facing, two rectilinear portions respectively adjacent to said openings and parallel to a direction of pull perpendicular to the back surface of the facing, two curved portions that respectively extend the two rectilinear portions and are sloped relative to the direction of pull, and at least one bend connecting the two curved portions.

9. The civil engineering work according to claim 1, wherein said anchoring element comprises a projection which extends transversely to a direction of pull perpendicular to the back surface of the facing, and wherein said cavity comprises a supporting section against which said projection from said anchoring element bears.

10. The civil engineering work according to claim 1, wherein it is chosen from a list of works consisting of a dam, an embankment, a canal levee, a fluid retaining structure, and a containment structure for materials which produce leachates.

11. A facing slab adapted to be assembled and to constitute a facing of a civil engineering work according to claim 3, said slab having a front surface and a back surface, said slab comprising at least one cavity which opens only onto said back surface, having at least one mouth and having a fluid-tight covering arranged continuously on the whole surface of said back surface, with a portion of the fluid-tight covering formed as a sealing member being arranged inside said cavity in a manner that forms a fluid-tight recessed space into which an anchoring element that is a part of an anchoring device can be inserted, and wherein the cavity and the recessed space are configured to allow mechanically anchoring the anchoring device in the facing slab, said fluid-tight covering being protected from material adjacent to the front face, the sealing member having a flat connecting surface encircling the cavity mouth, said connecting surface on the sealing member configured to be connected in a fluid-tight manner by a seal to a flat sealing plate extending along the back face.

12. A method for realizing a civil engineering work according to claim 1, wherein said method comprises the following steps:

a) erecting the facing on the substructure, with said facing comprising the fluid-tight covering arranged continuously on the whole back surface, b) installing a plurality of anchoring devices, c) installing the fill.

13. The method according to claim 12, wherein the work is realized in successive layers and wherein the successive steps a) to c) are repeated as many times as it is necessary to reach the desired height for the work.

14. The method according to claim 13, wherein, in the course of step b), in which a plurality of anchoring devices comprising a reinforcing strip are installed, the method comprises an operation of inserting the reinforcing strip into the cavity, with said method additionally comprising the following step:

adhering the fluid-tight covering between different layers in order to establish a fluid-tight seal.

* * * * *